US009677292B2

(12) United States Patent
Yang et al.

(10) Patent No.: US 9,677,292 B2
(45) Date of Patent: Jun. 13, 2017

(54) EMBEDDED INTEGRATED LIFTING ROTATION TABLE FOR A STAGE

(71) Applicant: ZHEJIANG DAFENG INDUSTRY CO., LTD., Yuyao (CN)

(72) Inventors: Weiguo Yang, Yuyao (CN); Qifei An, Yuyao (CN); Yuqing Chen, Yuyao (CN); Zhiqiao Fang, Yuyao (CN); Shihua Xia, Yuyao (CN); Zhao Zhang, Yuyao (CN); Jianjun Liu, Yuyao (CN); Wenjing Yin, Yuyao (CN); Junwei Dong, Yuyao (CN); Xiushuang Yang, Yuyao (CN); Shuyong Zhang, Yuyao (CN); Zhengjie Xu, Yuyao (CN); Fangqiu Zheng, Yuyao (CN)

(73) Assignee: ZHEJIANG DAFENG INDUSTRY CO., LTD., Yuyao (CN)

( * ) Notice: Subject to any disclaimer, the term of this patent is extended or adjusted under 35 U.S.C. 154(b) by 0 days.

(21) Appl. No.: 15/227,524

(22) Filed: Aug. 3, 2016

(65) Prior Publication Data

US 2017/0114557 A1 Apr. 27, 2017

(30) Foreign Application Priority Data

Oct. 26, 2015 (CN) ..... 2015 1 0705358

(51) Int. Cl.
*E04H 3/26* (2006.01)
*E04H 3/28* (2006.01)

(52) U.S. Cl.
CPC ..... *E04H 3/26* (2013.01); *E04H 3/28* (2013.01)

(58) Field of Classification Search
CPC ..... E04H 3/26; E04H 3/28; A63J 5/12
USPC ..... 52/7
See application file for complete search history.

(56) References Cited

U.S. PATENT DOCUMENTS 2,136,833 A * 11/1938 Young ..... A63J 1/00 359/445
3,383,810 A * 5/1968 Mola ..... E04B 1/346 52/65
3,812,631 A * 5/1974 Cruse ..... E04H 3/26 52/1
4,065,194 A * 12/1977 Mattia ..... E04H 3/26 108/147
4,600,085 A * 7/1986 Gagnon ..... B66B 9/025 182/141

(Continued)

*Primary Examiner* — Rodney Mintz
(74) *Attorney, Agent, or Firm* — Pearl Cohen Zedek Latzer Baratz LLP

(57) ABSTRACT

An embedded integrated lifting rotation table which comprises a lifting table and a rotation table which is embedded in the lifting table is disclosed. At least a group of rotating driving devices are installed on the lifting table to drive the rotation table to rotate. There are two lifting tables at least, each lifting table connects with a group of single lifting driving devices. The rotation table comprises at least two rotation table components joint together. The quantity of the rotation table components equals to the quantity of the lifting tables. Each lifting table is embedded with a rotation table component. The first locking device is installed between two adjacent rotation table components. The second locking device is installed between the lifting table and the rotation table components which is embedded in the lifting table.

10 Claims, 8 Drawing Sheets

(56) References Cited

U.S. PATENT DOCUMENTS

| | | | | | |
|---|---|---|---|---|---|
| 4,735,024 | A * | 4/1988 | Rosato | E04H 3/26 | 52/126.6 |
| 5,689,917 | A * | 11/1997 | St-Germain | E04H 3/26 | 52/10 |
| 7,007,428 | B2 * | 3/2006 | Santa Cruz | A63J 1/028 | 182/132 |
| 9,429,282 | B2 * | 8/2016 | Fruhm | A63J 1/00 | |
| 2011/0088975 | A1 * | 4/2011 | Ghorbani | A63J 5/12 | 182/141 |
| 2013/0327913 | A1 * | 12/2013 | Fruhm | A63J 1/00 | 248/349.1 |
| 2014/0230340 | A1 * | 8/2014 | Fox | E04H 3/26 | 52/1 |
| 2014/0360104 | A1 * | 12/2014 | Jannotti Newlands | G09F 23/02 | 52/7 |
| 2015/0141162 | A1 * | 5/2015 | Fox | E04H 3/26 | 472/75 |
| 2015/0184407 | A1 * | 7/2015 | Kaiturinmaki | B66F 7/02 | 254/89 R |
| 2015/0322667 | A1 * | 11/2015 | Malitskiy | E04H 3/12 | 52/28 |
| 2016/0041378 | A1 * | 2/2016 | Xu | G02B 21/26 | 248/349.1 |
| 2016/0346710 | A1 * | 12/2016 | Wu | A63J 5/12 | |

* cited by examiner

EMBEDDED INTEGRATED LIFTING ROTATION TABLE FOR A STAGE

CROSS-REFERENCE TO RELATED APPLICATIONS

This application claims priority to Chinese Application No. 201510705358.9, filed Oct. 26, 2015, which is hereby incorporated by reference in its entirety.

FIELD OF TECHNOLOGY

The present patent application relates to the field of stage performance, especially relates to an embedded integrated lifting rotation table.

BACKGROUND

The structure of the stage in the theater is a typical font "品", the stage equipment generally comprises the main stage lifting table and the rear wagon rotating stage. The motor function of this stage equipment is mostly single and the changes of the stage which are provided by the stage equipment are very limited. The stage equipment is huge, especially the rear wagon rotating stage. Because the whole volume and the overall weight are large, the requirement of the civil structure of the theatre and the manufacture and installation of the equipment is very high. The investment is high and the use ratio is low. Some theatres or performance places had to give up part or all these equipment during design and building. But with the complicated diversified layout of modern play, the requirement of audience for the drama performance improves continually, and the requirement of the entertainment equipment is higher. Light weight, multiple functions, convenient use, high-usage, high efficiency, economic, etc, has become the developing direction of the entertainment equipment in the future. For the theatre lack of investment scale, the stage equipment can reduce but the function is not reduced, it also can save construction investment.

SUMMARY

The present invention solves the above technical problem by providing a switchable embedded integrated lifting rotation table, it can be multiple groups separate lifting table, as well as can be a rotation table assembled with inlaid rotation table components.

In order to solve the problem mentioned above, the present patent application provides an embedded integrated lifting rotation table, which comprises lifting table and rotation table which is embedded in the lifting table. The lifting table is installed with at least one group of rotating driving device to drive the rotation table to rotate. There are two lifting tables at least, each lifting table connects with a group of single lifting driving devices. The rotation table comprises at least two rotation table components joint together. The quantity of the rotation table components equals to the quantity of the lifting tables. Each lifting table is embedded with a rotation table components. The first locking device is installed between two adjacent rotation table components. The second locking device is installed between the lifting table and the rotation table components which is embedded in the lifting table. When each lifting table goes up and down alone, the first locking device unlocks and the second locking device locks. When they assemble into a rotation table and rotate, the first locking device locks and the second locking device unlocks.

A revolving support is installed between the middle of the rotation table and the lifting table.

In one embodiment, a rotation ranging unit is installed on the lifting table and meshes with the revolving support. The rotation ranging unit comprises a small pinion, a big chain wheel coaxially arranged with the small pinion and a small chain wheel connects with the big chain wheel through the first chain. The small pinion meshes with the outer gear ring of the revolving support.

In one embodiment, a first encoder is coaxially installed on the mounting rack on which the small chain wheel is installed.

In one embodiment, multiple groups of toroidal flange rolling tread are installed below the rotation table. Multiple groups of rolling wheel devices are installed below each flange rolling tread.

In one embodiment, the rolling wheel device comprises a roller shelf fixed on the lifting table and a roller wheel supported by the roller shelf through the axle. The roller wheel abuts on the flange rolling tread.

In one embodiment, the roller wheel has steel core with rubber coating.

In one embodiment, the first locking device and the second locking device both comprise a fixed bracket, a motor-driven push-rod installed on the fixed bracket, a spline arranged on the end of the motor-driven push-rod, a gear meshes with the spline, a latch hook fixed connects with the gear and a lock pillar locked or unlocked by the latch hook. The gear is installed on the fixed bracket. There are two gears and they mesh with each other. The spline meshes with one of the gears. Each gear fixed connects with a latch hook.

In one embodiment, a slide component is installed on the fixed bracket. The slide component comprises a sliding block fixed connects with the spline and a guide rail fixed installed on the fixed bracket. The sliding block moves along the guide rail under the action of the motor-driven push-rod.

In one embodiment, the two latch hooks are staggered.

Compared with the prior art, the present patent application has below advantages. (1) The invention has simple structures and it can achieve both lifting table and rotation table. (2) The switching between the two functions is automatic and fast. (3) All the functions operate steadily and the noise is low. (4) The manufacture cost is low and it saves the construction investment. (5) It is convenient to be used and operated, and the maintenance is convenient.

2: lifting table, 3: rotation table, 4: rolling wheel device, 5: revolving support, 6: rotation ranging unit, 7: locking device, 8: friction ring, 10: rotating driving device, 31: rotation table component, 41: roller shelf, 42: axle, 43: roller wheel, 44: flange rolling tread, 51: outer gear ring, 61: small pinion, 62: big chain wheel, 63: first chain, 64: small chain wheel, 65: first encoder, 66: mounting rack, 71: sliding block, 72: spline, 73: wheel gear, 74: latch hook, 75: fixed bracket, 76: motor-driven push-rod, 77: lock pillar, 78: lock pillar support, 79: guide rail, 101: pinch roller, 102: friction wheel, 103: tension spring, 104: adjustment lever, 105: second chain, 106: first chain wheel, 107: gear motor, 108: encoder, 109: second chain wheel, 110: strip-type mounting hole, 111: pedestal, 112: pull rod, 113: electrical machine mounting plate, 114: handle.

DETAILED DESCRIPTION

The principles of the present patent application will be further described with reference to the embodiments and the drawings. However, the following embodiments shall not be regarded as limiting of the present invention.

Figure 1:
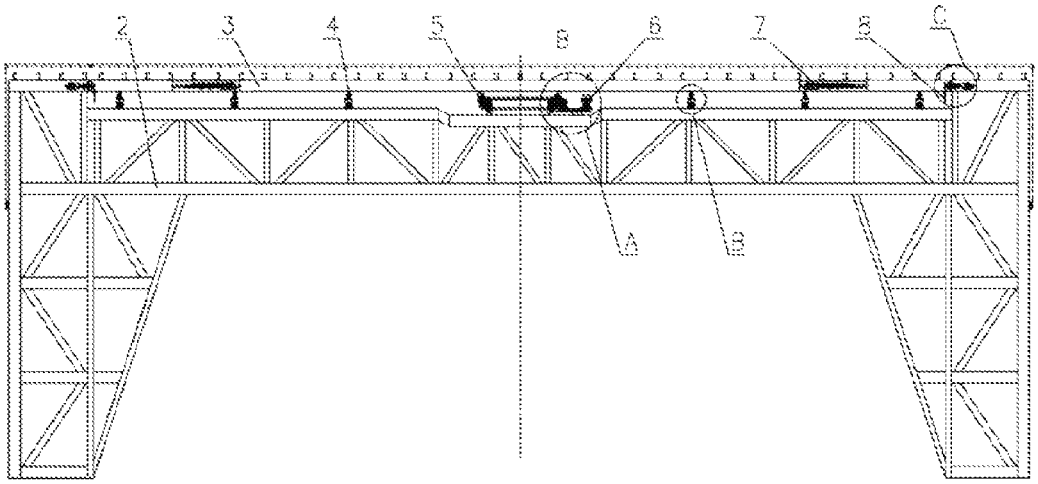
FIG. 1 is a front structure diagram of the embedded integrated lifting rotation table.
Figure 2:
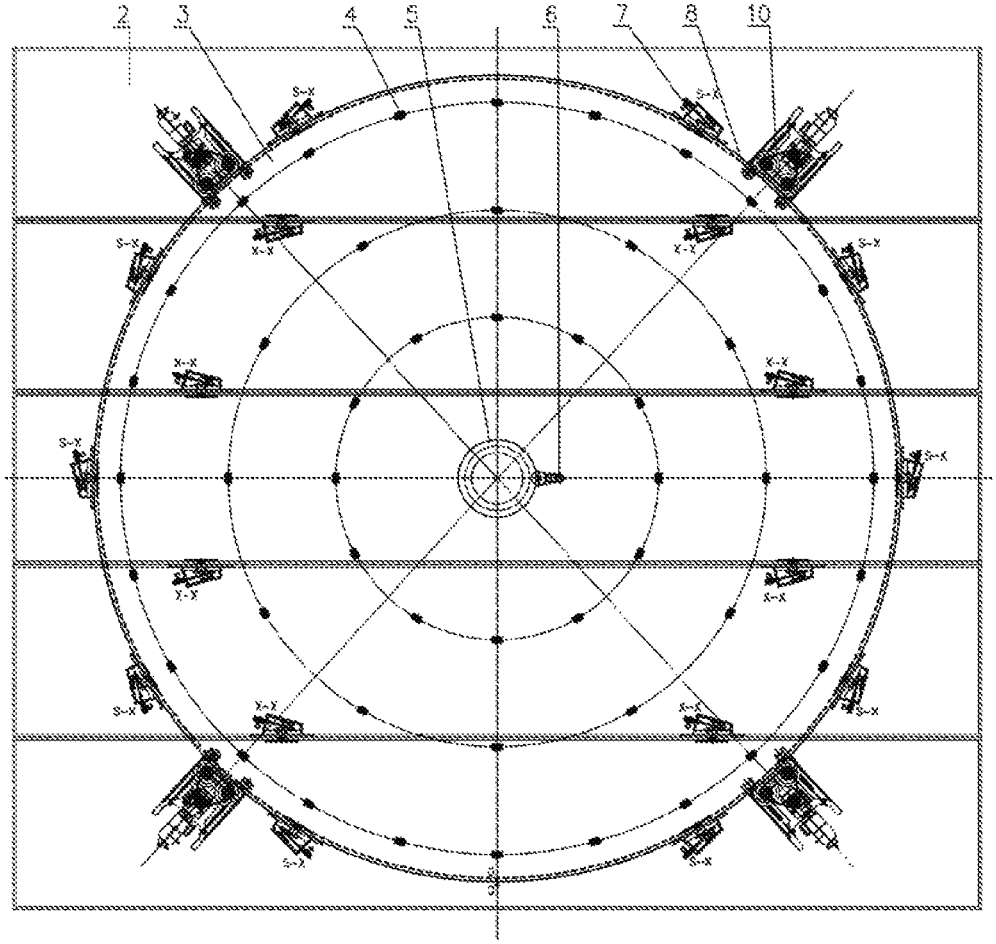
FIG. 2 is a top view of the embedded integrated lifting rotation table.

As show in FIG. 1 and FIG. 2, the embedded integrated lifting rotation table comprises a lifting table and a rotation table which is embedded in the lifting table. The lifting table is installed with at least one group of rotating driving device to drive the rotation table to rotate. There are two lifting tables at least, each lifting table connects with a group of single lifting driving devices. The rotation table comprises at least two rotation table components joint together. The quantity of the rotation table components equals to the quantity of the lifting tables. Each lifting table is embedded with a rotation table components. The first locking device is installed between two adjacent rotation table components. The second locking device is installed between the lifting table and the rotation table components which is embedded in the lifting table. When each lifting table goes up and down alone, the first locking device unlocks and the second locking device locks. When they assemble into a rotation table and rotate, the first locking device locks and the second locking device unlocks. In this embodiment, the numbers of the lifting table and the rotation table are five.

Figure 6:
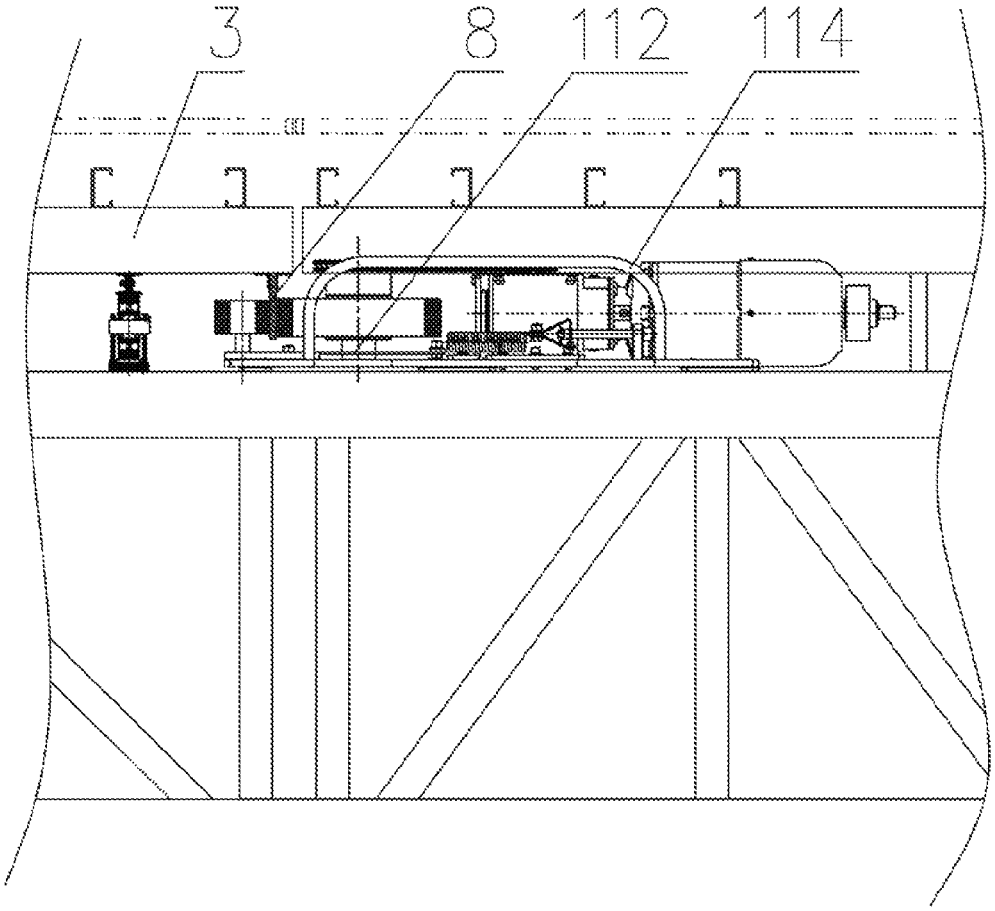
FIG. 6 is the front structure diagram of the rotating driving device of the embedded integrated lifting rotation table.
Figure 7:
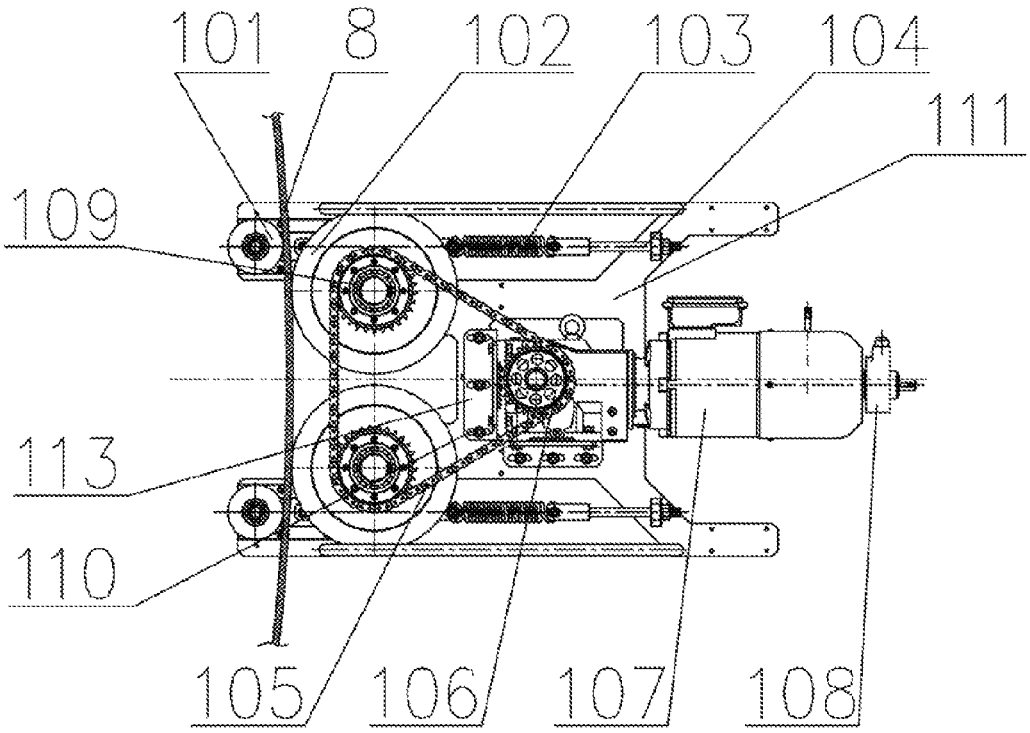
FIG. 7 is the planform of FIG. 6.

As show in FIG. 6 and FIG. 7, a friction ring 8 is installed blow the rotation table. Multiple group rotating driving devices are evenly installed around the friction ring 8. Each rotating driving device comprises a pedestal 111, a friction wheel 102 installed on the pedestal 111 and a gear motor 107 drives the friction wheel 102 to rotate. There are two friction wheels 102 and they fit closely with the outside of the friction ring 8.

The gear motor 107 connects with the friction wheel 102 through the chain transmission. The chain transmission comprises the first chain wheel 106 arranged on the output shaft of the gear motor 107, the second chain wheel 109 coaxially arranged with on the friction wheel 102 and the second chain 105 meshes with the first chain wheel 106 and the second chain wheel 109, respectively.

An encoder 108 is arranged on the rear-end of the gear motor and used to test the angular displacement of the rotation table rotating and control the revolving speed of the gear motor.

The gear motor 107 is installed on the pedestal 111 through the electrical machine mounting plate 113. Multiple strip-type mounting holes 110 are evenly arranged on the electrical machine mounting plate 113 and in order to adjust the position of the motor and make sure that the chain wheel is in the tension state.

Each rotating driving device comprises pinch roller 101 arranged on the outside of the friction ring 8. The pinch roller 101 makes the friction ring fit closely with the friction wheel.

There are two pinch rollers 101.

A control apparatus is arranged on each pinch roller 101. The control apparatus comprises a pull rod 112 connects with the pinch roller 101, an adjustment lever 104 installed on the pedestal 111 and a tension spring 103 connects the pull rod 112 with the adjustment lever 104. The adjustment lever 104 is used to adjust the pressing force of the pinch roller to make sure that the force of friction of each rotating driving device is mostly same.

Two handles 114 are fixedly installed on the two sides of the pedestal 111. It is convenient for the movement, the dismounting and the later maintenance of the driving device.

Figure 5:
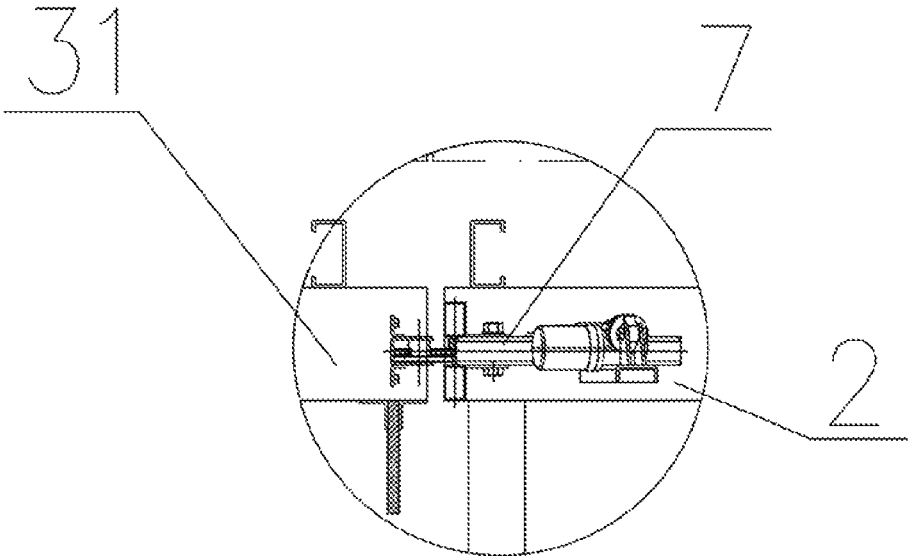
FIG. 5 is an enlarged view of C in FIG. 1.
Figure 8:
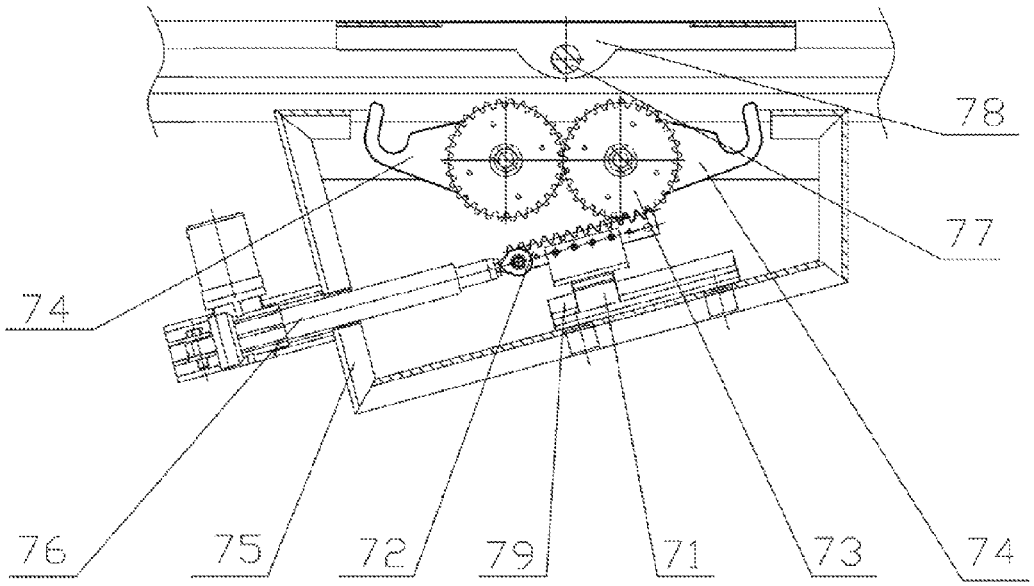
FIG. 8 is the structure diagram of the locking device unlocks of the embedded integrated lifting rotation table.
Figure 9:
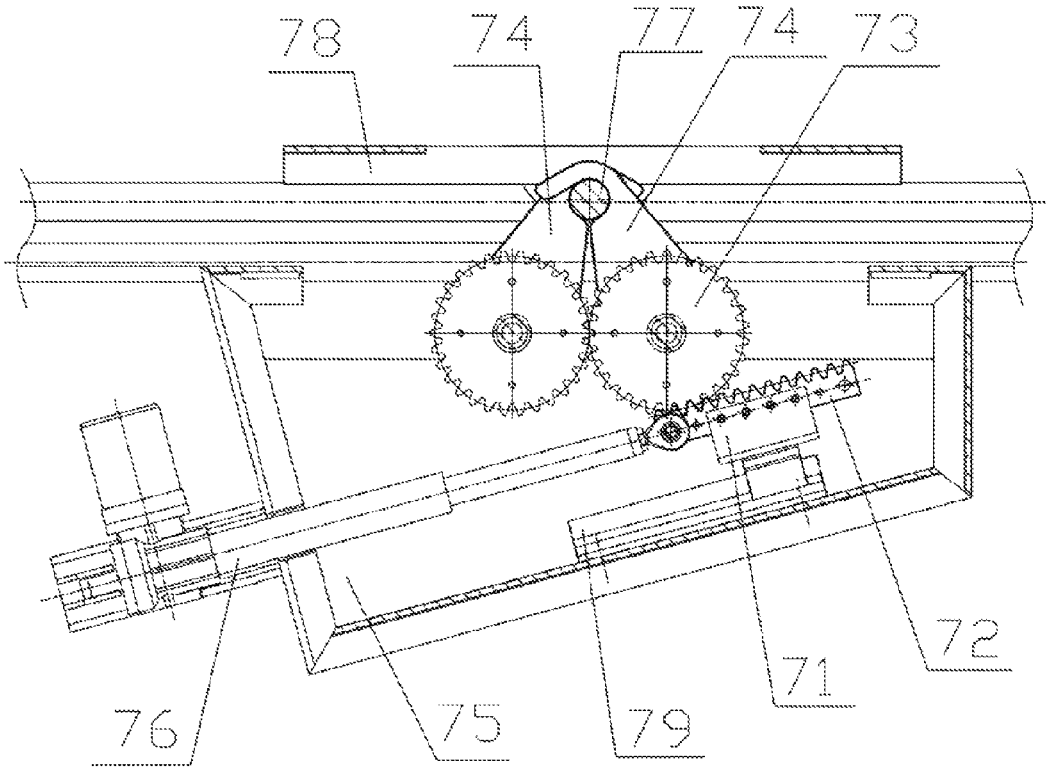
FIG. 9 is the structure diagram of the locking device locks of the embedded integrated lifting rotation table.

The locking device 7 comprises the first locking device X-X and the second locking device S-X. As show in FIG. 5, FIG. 8 and FIG. 9, the locking device 7 comprises a fixed bracket 75, a motor-driven push-rod 76 installed on the fixed bracket 75, a spline 72 arranged on the end of the motor-driven push-rod 76, a gear 73 meshes with the spline 72, a latch hook 74 fixed connects with the gear 73 and a lock pillar 77 locked or unlocked by the latch hook 74. The gear 73 is installed on the fixed bracket 75. The fixed bracket 75 is fixedly installed on the rotation table component 31 or the lifting table 2. The lock pillar 77 is fixedly installed on the locked side of the rotation table component 31 or the lifting table 2 though the lock pillar support 78.

There are two gears 73 and they mesh with each other. The spline 72 meshes with one of the gears 73. Each gear 73 fixed connects with a latch hook 74. Double latch hook device ensures the security of the locking device.

The two latch hook 74 are staggered.

The slide component is installed on the fixed bracket 75. The slide component comprises a sliding block 71 fixed connects with the spline and a guide rail 79 fixed installed on the fixed bracket 75. The sliding block 71 moves along the guide rail 79 under the action of the motor-driven push-rod 76 to ensure that the spline meshes with the gear well when moving.

A revolving support 5 is installed between the middle of the rotation table 3 and the lifting table 2.

Figure 3:
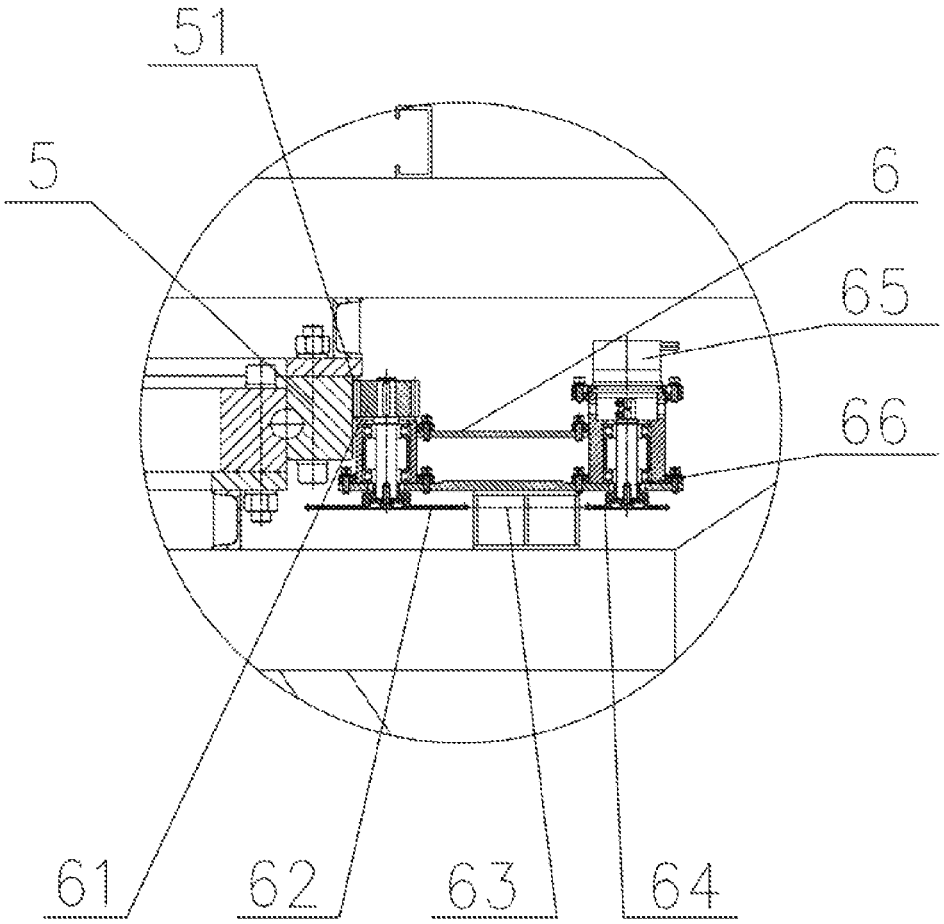
FIG. 3 is an enlarged view of A in FIG. 1.

A rotation ranging unit 6 is installed on the lifting table 2 and meshes with the revolving support 5. As show in FIG. 3, the rotation ranging unit 6 comprises a small pinion 61, a big chain wheel 62 coaxially arranged with the small pinion 61 and a small chain wheel 64 connects with the big chain wheel 62 through the first chain 63. The small pinion 61 meshes with the outer gear ring 51 of the revolving support 5.

A first encoder 65 is coaxially installed on the mounting rack 66 on which the small chain wheel 64 is installed. The first encoder 65 increases speed two-stage through the gear and the chain wheel and greatly improves the precision of ranging and the accuracy of rotation location.

Figure 4:
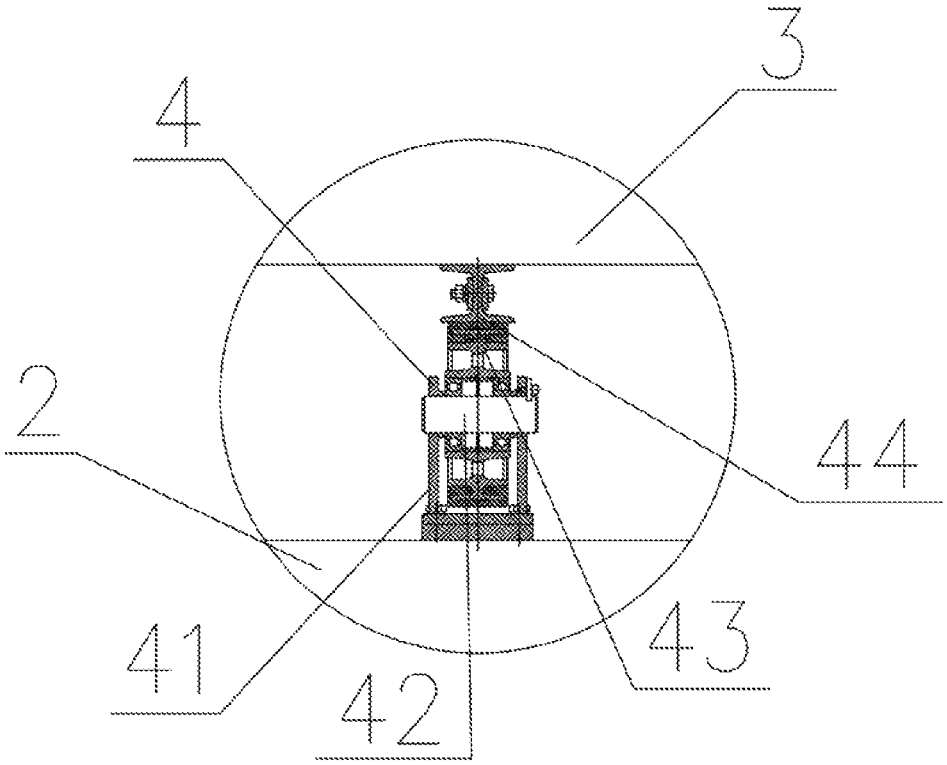
FIG. 4 is an enlarged view of B in FIG. 1.

As show in FIG. 4, multiple groups of toroidal flange rolling tread 44 are installed below the rotation table 3. At least one group of rolling wheel devices 4 is installed below each flange rolling tread 44. The rolling wheel device 4 comprises a roller shelf 41 fixed on the lifting table 2 and a roller wheel 43 supported by the roller shelf 41 through the axle 42. The roller wheel 43 abuts on the flange rolling tread 44. The tread faces down and the flange of the roller wheel faces up. It can effectively prevent the foreign matter landed on the tread and influenced the smooth running of the rotation table.

The roller wheel 43 has steel core with rubber coating. It can effectively reduce the noise.

When each lifting table 2 goes up and down alone, the first locking device X-X installed between two adjacent rotation table components 31 unlocks and the second locking device S-X between the lifting table 2 and the rotation table components 31 locks. At this point, the rotation table components 31 embedded in each lifting table 2 disengage completely and are locked firmly on its embedded lifting table 2. At this point, each lifting table 2 goes up and down alone under the drive of each driving device. When use the rotation table, each lifting table runs to the same height. The first locking device X-X between two adjacent rotation table components 31 locks and the second locking device S-X between the lifting table 2 and the rotation table components 31 unlocks. At this point, the rotation table components 31 embedded in each lifting table 2 are locked firmly with each other and separate completely with the lifting table 2. The rotation table components 31 are locked together and form a complete circular rotation stage. Start the drive device and the rotation stage can rotate. The invention has simple structures and it can achieve both lifting table and rotation table, the switching between the two functions is automatic and fast. All the functions operate steadily. The manufacture cost is lower and it saves the construction investment. It is convenient to be used and the maintenance is convenient.

Although the invention has been described with respect to certain embodiments, the description is not regarded as limiting of the invention. The alternative changes or modifications of aspects of the embodiments of the invention fall within the spirit of the present invention.

What is claimed is:

1. An embedded integrated lifting rotation table, comprising:

a lifting table (2), and a rotation table (3) which is embedded in the lifting table (2), wherein the lifting table (2) is installed with at least one group of rotating driving device (10) to drive the rotation table (3) to rotate, the quantity of the lifting table is at least two, each lifting table (2) connects with a group of separated lifting driving devices, the rotation table (3) comprises at least two rotation table components (31) joining together, the quantity of the rotation table components (31) equals to the quantity of the lifting tables (2), each lifting table (2) is embedded with a rotation table components (31), a first locking device is installed between two adjacent rotation table components (31), a second locking device is installed between the lifting table (2) and the rotation table components (31) which is embedded in the lifting table (2), when each lifting table (2) goes up and down independently, the first locking device unlocks and the second locking device locks, when each lifting table (2) assemble into a rotation table (3) to rotate, the first locking device locks and the second locking device unlocks.

2. The embedded integrated lifting rotation table in claim 1, wherein a revolving support (5) is installed between a middle of the rotation table (3) and the lifting table (2).

3. The embedded integrated lifting rotation table in claim 2, wherein a rotation ranging unit (6) is installed on the lifting table (2) and meshes with the revolving support (5), the rotation ranging unit (6) comprises a small pinion (61), a big chain wheel (62) coaxially arranged with the small pinion (61), and a small chain wheel (64) connecting with the big chain wheel (62) through the first chain (63), the small pinion (61) meshes with the outer gear ring (51) of the revolving support (5).

4. The embedded integrated lifting rotation table in claim 3, wherein a first encoder (65) is coaxially installed on the mounting rack (66) on which the small chain wheel (64) is installed.

5. The embedded integrated lifting rotation table in claim 1, wherein multiple groups of toroidal flange rolling tread (44) are installed below the rotation table (3), multiple groups of rolling wheel devices (4) are installed below each flange rolling tread (44).

6. The embedded integrated lifting rotation table in claim 5, wherein the rolling wheel device (4) comprises a roller shelf (41) fixed on the lifting table (2) and a roller wheel (43) supported by the roller shelf (41) through a axle (42), the roller wheel (43) abuts on the flange rolling tread (44).

7. The embedded integrated lifting rotation table in claim 6, wherein the roller wheel (43) has a steel core with a rubber coating.

8. The embedded integrated lifting rotation table in claim 1, wherein both the first locking device and the second locking device comprise a fixed bracket (75), a motor-driven push-rod (76) installed on the fixed bracket (75), a spline (72) arranged on an end of the motor-driven push-rod (76), a gear (73) meshes with the spline (72), a latch hook (74) fixed connecting with the gear (73), and a lock pillar (77) locked or unlocked by the latch hook (74); the gear (73) is installed on the fixed bracket (75), the quantity of the gear (73) is two; the two gears (73) mesh with each other, the spline (72) meshes with one of the gears (73), each gear (73) fixed connects with a latch hook (74).

9. The embedded integrated lifting rotation table in claim 8, wherein a slide component is installed on the fixed bracket (75), the slide component comprises a sliding block (71) fixed connecting with the spline, and a guide rail (79) fixed installed on the fixed bracket (75); the sliding block (71) moves along the guide rail (79) under an action of the motor-driven push-rod (76).

10. The embedded integrated lifting rotation table in claim 8, wherein the two latch hooks (74) are staggered.

* * * * *